United States Patent [19]

Ueda et al.

[11] Patent Number: 4,907,722

[45] Date of Patent: Mar. 13, 1990

[54] EASILY OPENABLE SEALED CONTAINER

[75] Inventors: Kazuo Ueda; Takehiko Aihara, both of Tokushima, Japan

[73] Assignee: Shikoku Kakoki Co., Ltd., Tokushima, Japan

[21] Appl. No.: 162,933

[22] Filed: Mar. 2, 1988

[30] Foreign Application Priority Data

Mar. 4, 1987 [JP] Japan ..... 62-32413[U]

[51] Int. Cl.[4] ..... B67B 7/24

[52] U.S. Cl. ..... 222/83; 222/553; 220/277; 220/278

[58] Field of Search ..... 222/83, 81, 553, 83.5; 220/277, 278, 401

[56] References Cited

U.S. PATENT DOCUMENTS

| | | | |
|---|---|---|---|
| 2,698,113 | 12/1954 | Linton | 222/83 |
| 3,642,172 | 2/1972 | Malpas | 222/183 X |
| 4,322,018 | 3/1982 | Rutter | 222/83 |
| 4,469,249 | 9/1984 | Malpas et al. | 222/83 |

*Primary Examiner*—George T. Hall

*Attorney, Agent, or Firm*—Armstrong, Nikaido, Marmelstein & Kubovcik

[57] ABSTRACT

An easily openable sealed container comprising a rectangular parallelepipedal main body and a caplike reinforcing cover fitted over the top end of the main body. The top wall of the main body is provided with an opening forming thin wall portion. The cover has a top wall provided with an aperture opposed to the thin wall portion and an externally threaded spout projecting upward from the aperture-defining edge portion of the wall. A cap nut screwed on the spout has integral therewith a cutter for cutting the thin wall portion.

4 Claims, 4 Drawing Sheets

EASILY OPENABLE SEALED CONTAINER

BACKGROUND OF THE INVENTION

The present invention relates to a sealed container for containing fluid foods such as juice.

Conventional containers for such foods include cans and paper containers. Cans can not be incinerated and therefore have the problem of being difficult to dispose of after use and becoming a nuisance. Cans have another problem in that since the contents enclosed therein are retorted for sterilization, this process impairs the taste or flavor of the contents. These problems can be overcome by paper containers, which nevertheless have the following problem. If an opening is formed in the top wall of the container by locally breaking the wall, a jagged broken edge becomes exposed around the opening, making the opening appear unsightly.

SUMMARY OF THE INVENTION

The main object of the present invention is to provide a sealed container for beverages which is free of the problems heretofore encountered with cans and paper containers.

The invention provides an easily openable sealed container which comprises a rectangular parallelepipedal main body made of a paper-base laminate and having a top wall and a trunk wall, the top wall being formed with an opening forming thin wall portion; a caplike reinforcing cover fitted over the top end of the main body and having a top wall and a peripheral wall, the cover top wall being provided with an aperature opposed to the thin wall portion and an externally threaded spount projecting upward from the aperture-defining edge portion of the wall; a cap nut screwed on the spout and having a peripheral wall and a top wall; and a cutter integral with the cap nut for cutting the thin wall portion.

According to the present invention, the thin wall portion formed in the top wall of the container main body is cut with the cutter on the cap nut to form an opening. This opening is held out of sight by the reinforcing cover and therefore does not appear unsightly. Moreover, the contents poured from the opening can be guided by the spout into a cup or the like without spilling, while the container can be closed again readily with the cap nut.

DESCRIPTION OF THE PREFERRED EMBODIMENT

An embodiment of the invention will be described below with reference to the drawings.

Figure 1:
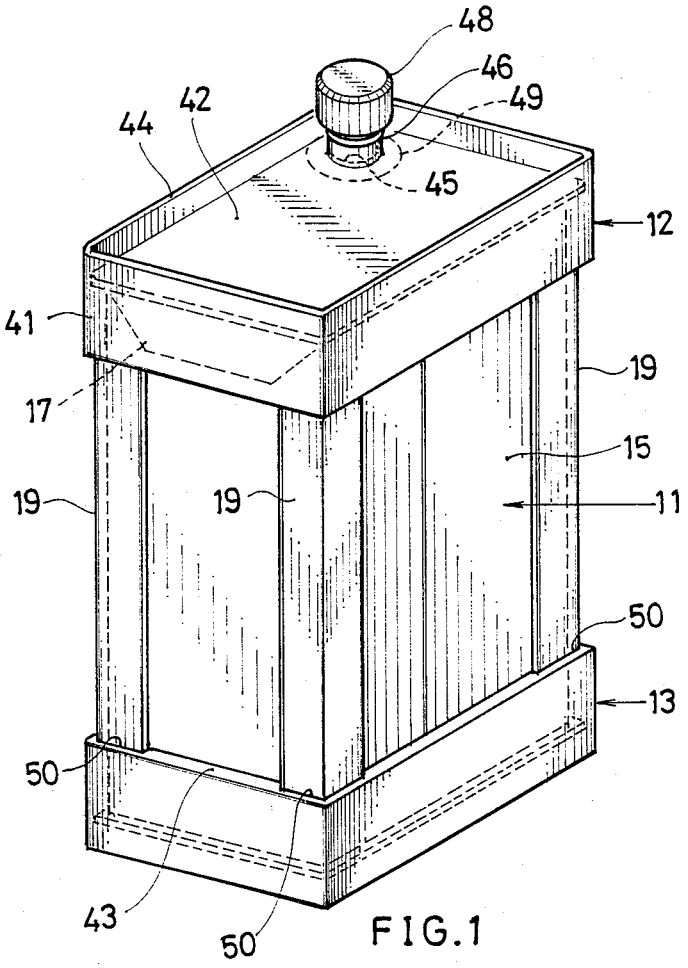
FIG. 1 is a perspective view showing a container embodying the invention.
Figure 2:
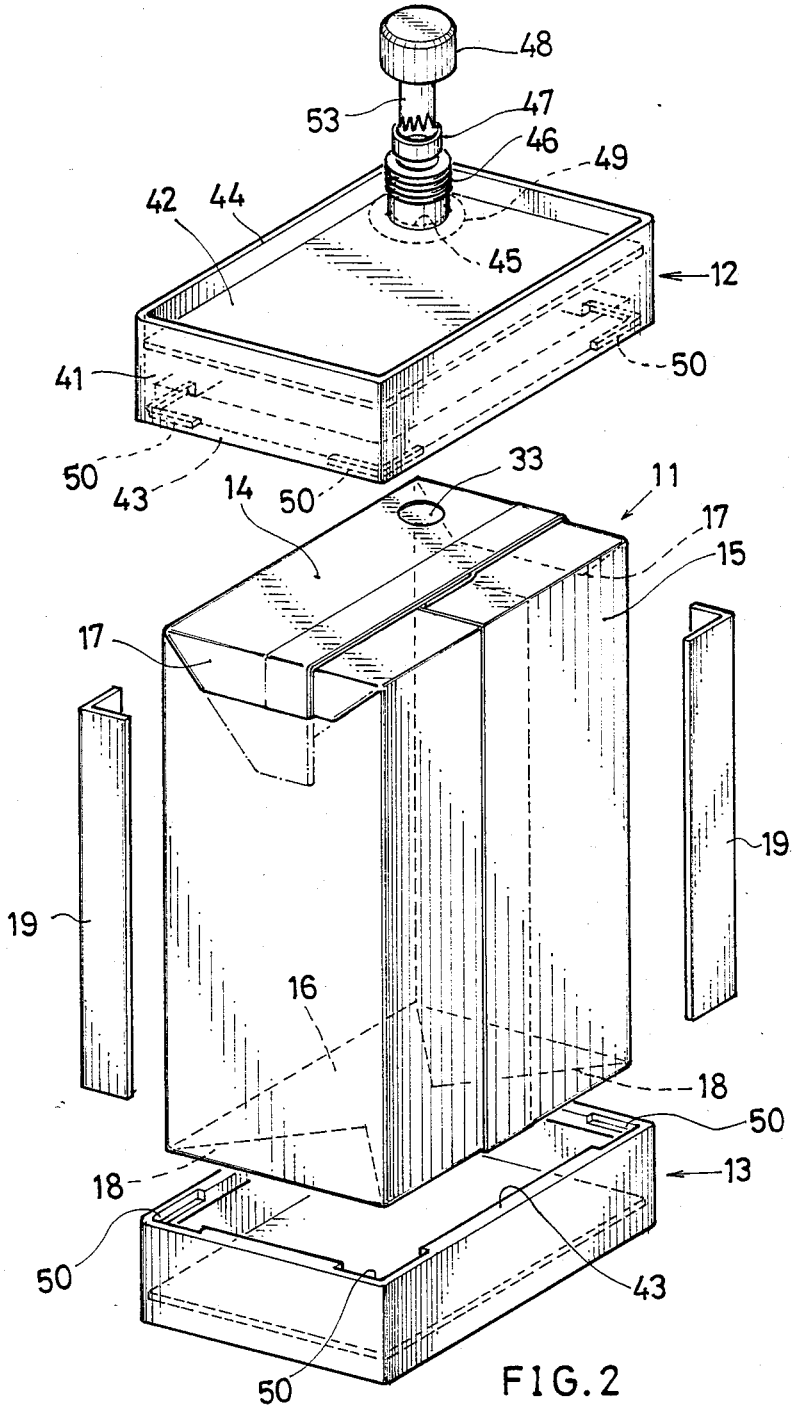
FIG. 2 is an exploded perspective view of the container.
Figure 3:
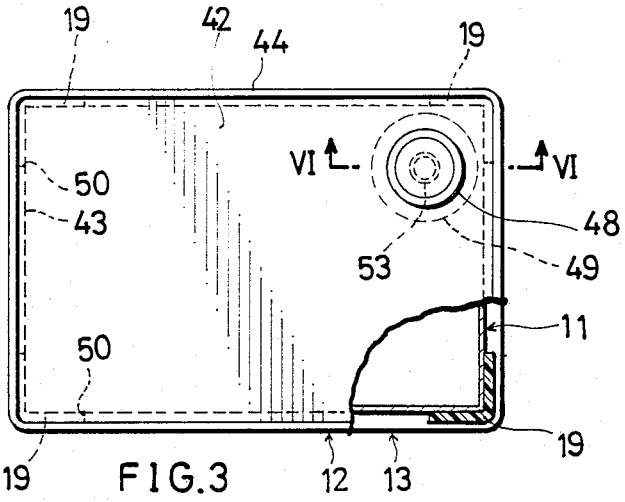
FIG. 3 is a plan view of the container.
Figure 4:
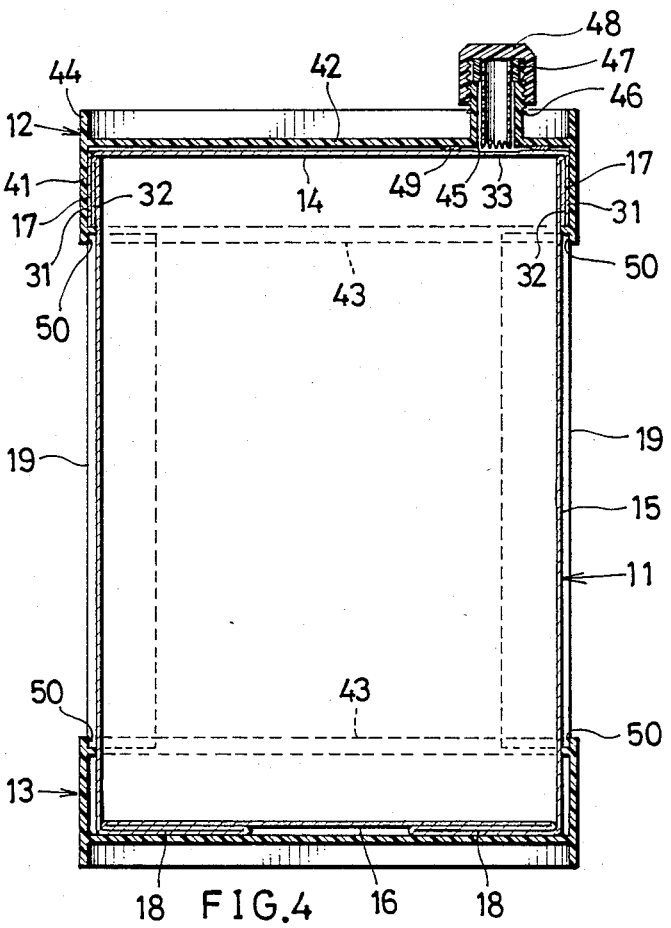
FIG. 4 is a view in vertical section showing the container.

FIGS. 1 and 2 show a sealed container which is easily openable. The illustrated container comprises a rectangular parallelepipedal main body 11 having a larger length in the right-to-left (i.e. sidewise) direction than in the front-to-rear direction when seen from above, and upper and lower caplike reinforcing covers 12, 13 fitted over the upper and lower ends of the body 11, respectively. A reinforcing piece 19, L-shaped in cross section, is fitted to each of the four vertical corners of the main body 11.

Figure 6:
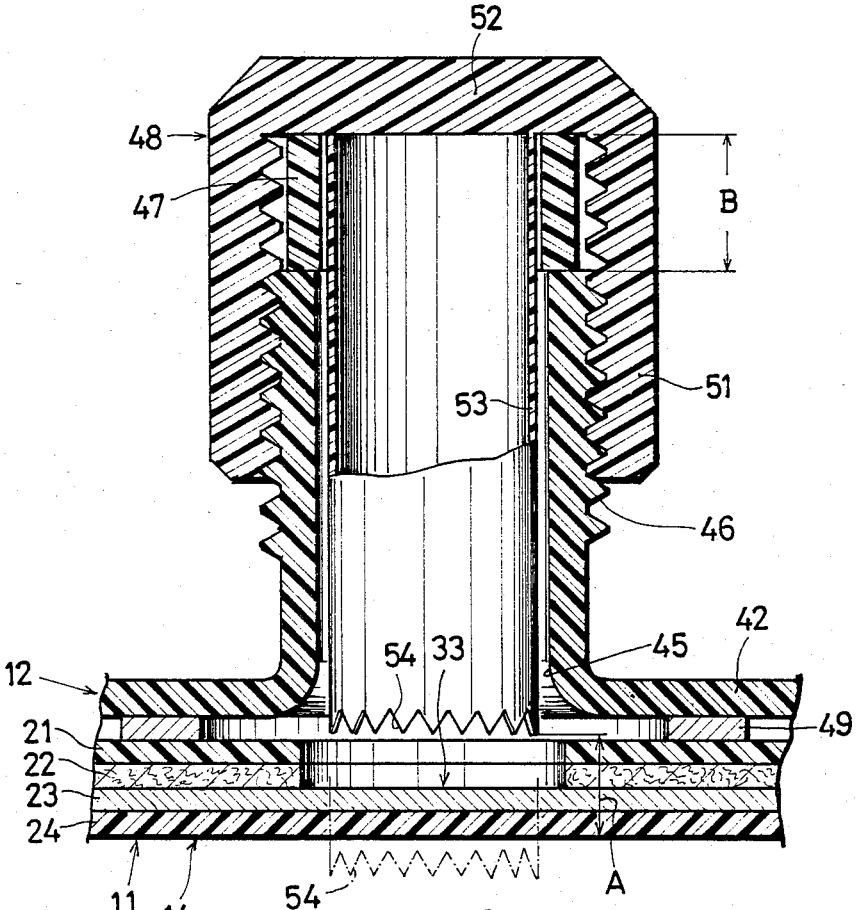
FIG. 6 is an enlarged view in section taken along the line VI—VI in FIG. 3.

The container main body 11 is of the known type except the two features given below and will therefore be described only briefly. The main body 11 comprises a top wall 14, a trunk wall 15, a bottom wall 16, two top ears 17 integral with the top wall 14 and the trunk wall 15 at two ridges in the front-to-rear direction and folded over and bonded by fusion to the trunk wall 15, and two bottom ears 18 integral with the trunk wall 15 and the bottom wall 16 at the two ridges in the front-to-rear direction and folded over and bonded by fusion to the bottom wall 16. As seen in FIG. 6, the main body 11 comprises an outer layer 21 of thermoplastic synthetic resin, a paper layer 22, an aluminum foil layer 23 and an inner layer 24 of thermoplastic synthetic resin, as arranged from the outer side inward in this order.

Figure 5:
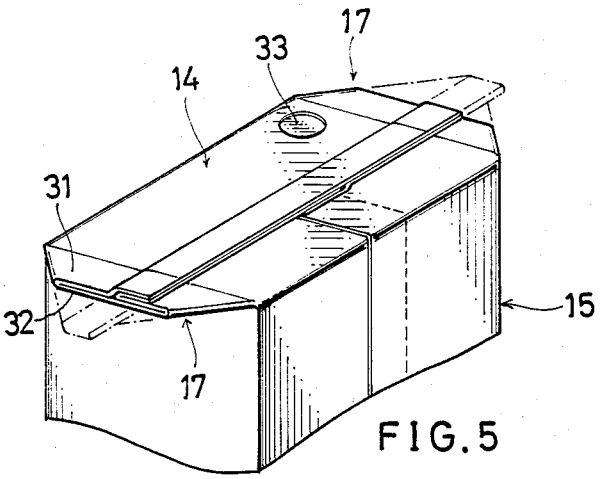
FIG. 5 is a fragmentary perspective view showing the container while it is being formed.

The two features will now be described. First, the top ear 17 differs from the conventional one in shape. With reference to FIG. 5, the top ear 17 comprises a front portion 31 integral with the right or left side edge of the top wall 14, and a rear portion 32 integral with the upper edge of the trunk wall 15. The two portions 31, 32 merely lap over each other and are triangular at first as indicated in broken lines in FIG. 5 but are thereafter bonded to each other by fusion and have their forward ends removed to assume a trapezoidal shape.

Second, the top wall 14 of the main body 11 has an opening forming thin wall portion 33. With reference to FIG. 6, the outer resin layer 21 and the paper layer 22 are locally removed from the top wall 14, leaving the aluminum foil layer 23 and the inner resin layer 24 unremoved for these layers to provide the thin wall portion 33 at the removed location. When seen from above, the thin wall portion 33 is circular.

The upper reinforcing cover 12 is prepared from a thermoplastic synthetic resin generally in the form of a cap and comprises a peripheral wall 41 and a top wall 42. The peripheral wall 41 is formed close to its lower end with an inward flange 43, which is bonded by fusion to the trunk wall 15 of the main body 11. The flange 43, which is rectangular, has a cutout 50 at each of its four corners. An endless bank 44 is formed on the upper side of the top wall 42 along its peripheral edge. The cover top wall 42 is provided with an aperture 45 opposed to the thin wall portion 33 of the main body 11, and an externally threaded spout 46 in the form of a hollow cylinder and projecting upward from the aperture-defining edge portion of the wall 42. With an annular spacer 47 placed on the spout 46, a cap nut 48 is screwed on the spout 46. A ring 49 of aluminum foil is interposed between the cover top wall 42 and the main body top wall 14. The aluminum foil ring 49 has an upper surface bonded by fusion to the lower surface of the top wall 42 around the aperture 45 and a lower surface bonded by fusion to the upper surface of the top wall 14 around the thin wall portion 33. Both the spacer 47 and the cap nut 48 are made of synthetic resin. The cap nut 48 comprises a peripheral wall 51 and a top wall 52. A cutter 53 in the form of a hollow cylinder is integral with the top wall 53 and extends therefrom downward. The cutter 53 is positioned inside the spacer 47 and the spout 46 and is concentric with the peripheral wall 51 of the cap nut 48. The cutter 53 is formed at its lower end with a serrated cutting blade 54. The distance A from the lower end of the cutting blade 54 to the lower surface of the thin wall portion 33 is smaller than the vertical thickness B of the spacer 47.

The lower reinforcing cover 13 has the same construction as the upper cover 12 except that the cover 13 has neither the aperture 45 nor the spout 46, and therefore will not be described.

The reinforcing piece 19 is made of thermoplastic synthetic resin and has its opposite ends fitted in the opposed cutouts 50 in the flanges 43 of the upper and lower covers 12, 13. The reinforcing piece 19 is bonded to the trunk wall 15 at a plurality of portions of the piece spaced apart lengthwise thereof.

To open the container, the cap nut 48 is removed from the spout 46 once, the spacer 47 is removed and the nut 48 is screwed on the spout 46 again. As the cap nut 48 is advanced, the cutting blade 54 comes into contact with the peripheral edge of the thin wall portion 33 on the upper side thereof. When the nut 48 is further advanced, the thin wall portion 33 is cut off along the edge, forming an opening at the cut-off portion. The contents can be poured out after removing the cap nut 48 from the spout 46. The container can be closed again thereafter by fitting the cap nut 48 over the spout 46.

What is claimed is:

1. An easily openable sealed container comprising:

a rectangular parallelepipedal main body made of a paper-base laminate and having a top wall and a trunk wall, the top wall being formed with an opening forming thin wall portion, a caplike reinforcing cover fitted over the top end of the main body and having a top wall and a peripheral wall, the cover top wall being provided with an aperture opposed to the thin wall portion and an externally threaded spout projecting upward from the aperture-defining edge portion of the wall, a cap nut screwed on the spout and having a peripheral wall and a top wall, and a cutter integral with the cap nut for cutting the thin wall portion.

2. A container as defined in claim 1 wherein an annular spacer is interposed between the upper end of the spout and the top wall peripheral portion of the cap nut, and the cutter is in the form of a hollow cylinder and is positioned inside the spout and the spacer, the cutter extending downward from the top wall of the cap nut concentrically with the peripheral wall thereof and having a cutting blade at its lower end, the distance from the lower end of the cutting blade to the lower surface of the thin wall portion being not greater than the vertical thickness of the spacer.

3. A container as defined in claim 1 or 2 wherein the main body comprises an outer layer of thermoplastic synthetic resin, a paper layer, an aluminum foil layer and an inner layer of thermoplastic synthetic resin as arranged in this order from the outer side of the body inward, and the outer resin layer and the paper layer are locally removed from the main body top wall for the aluminum foil layer and the inner resin layer remaining in the removed location to provide the opening forming thin wall portion.

4. A container as defined in claim 3 wherein the reinforcing cover is made of thermoplastic synthetic resin and provided at the lower end of its peripheral wall with an inward flange bonded to the main body trunk wall by fusion, and a ring of aluminum foil is thermally bonded over the upper surface thereof to the lower surface of the cover top wall around the aperture and over the lower surface thereof to the upper surface of the main body top wall around the thin wall portion.

* * * * *